US006390834B1

(12) United States Patent
Hofmeister et al.

(10) Patent No.: US 6,390,834 B1
(45) Date of Patent: May 21, 2002

(54) PROTECTIVE DEVICE FOR A PLUG CONNECTOR

(75) Inventors: Werner Hofmeister, Muehlacker; Frank Oettinger, Vaihingen-Ensingen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/706,411

(22) Filed: Nov. 3, 2000

(30) Foreign Application Priority Data

Nov. 3, 1999 (DE) ..... 299 19 279 U

(51) Int. Cl.[7] ..... H01R 13/44
(52) U.S. Cl. ..... 439/140; 439/380
(58) Field of Search ..... 439/380, 381, 439/79, 140, 141

(56) References Cited

U.S. PATENT DOCUMENTS 5,035,633 A * 7/1991 Kobayashi et al. ..... 439/140
6,203,356 B1 * 3/2001 Thomsen ..... 439/381

FOREIGN PATENT DOCUMENTS

DE 94 20 525 6/1996

* cited by examiner

*Primary Examiner*—Tho D. Ta
*Assistant Examiner*—Ann McCamey
(74) *Attorney, Agent, or Firm*—Kenyon & Kenyon

(57) ABSTRACT

An electrical plug-and-socket connection is described. The electrical plug-and-socket connection having a plug and a plug connector, in particular for receiving a cable harness plug. The plug connector includes a housing provided with a plug connector opening in which a plurality of pin contacts directed toward the plug connector opening are provided for establishing an electrical contact. The plug connector further includes a protective device which has at least one opening for the passage of a pin contact and can be latched in a protective position using at least one latch element. The protective device can be brought from the protective position into an assembly position by joining the plug connector with the plug. At least one contact element, which works together with the latch element and releases the latch connection between the plug and the plug connector as the plug is attached to the plug connector is provided on the plug for actuating the protective device.

7 Claims, 5 Drawing Sheets

PROTECTIVE DEVICE FOR A PLUG CONNECTOR

FIELD OF THE INVENTION

The present invention relates to an electrical plug-and-socket connection. The plug-and-socket connection includes a plug and a connecting element in the form of a plug connector, in particular for receiving a cable harness plug. The plug connector includes a housing provided with a plug connector opening in which a plurality of pin contacts directed toward the plug connector opening are provided for establishing an electrical contact. The plug also includes a protective device which has at least one opening for the passage of a pin contact and can be latched in a protective position using at least one latch element. The protective device can be brought from the protective position into an assembly position by joining the plug connector with the plug.

BACKGROUND INFORMATION

Protective devices of the type described above may be used for protecting plug connectors having very thin contact elements, e.g., pin contacts, in particular regarding their cross-section, against unintentional bending or damage. For this purpose, a strip-type protective device is described in German Utility Patent 94 20 525 U1. The protective device described therein has a plurality of bushings for receiving pin contacts. The pin contacts are completely covered in the protective position and exposed for electrical contact in the assembly position.

Furthermore, conventional protective devices can be inserted in a plug connector opening using complicated designs. However, they must be removed from the plug connector opening prior to attaching a plug.

In particular, in the case of male multiplug connectors, the pin contacts are usually secured using a protective cap by pressing this protective cap onto the pin contacts.

One disadvantage of such conventional protective devices is that protective devices that are to be removed manually may be accidentally left in. In addition, depending on the design of such a protective device, more room may be needed in order to guarantee the function of such a protective device.

Furthermore, another disadvantage of conventional protective devices is that protective devices arranged in the plug connector openings have a very complex design and are therefore very expensive to manufacture and complicated to install.

SUMMARY

An object of the present invention is to improve an electrical plug-and-socket connection so that a protective device is created without changing the plug geometry, which protects small-cross-section pin contacts in particular against damage in a simple and functional manner.

This object is achieved by providing a plug-and-socket connection designed so that a contact element which works together with the latch element and releases the latch connection as the plug is attached to the plug connector is provided on the plug for actuating the protective device.

According to the present invention, a protective device, for example, designed as a plate or a strip, is mounted within a plug connector opening of a plug connector in a displaceable manner without it being necessary to remove this protective device from the plug connector opening, for example, using tools in order to attach a plug.

This allows very simple handling without danger of such a protective device being forgotten, for example, for transport. Furthermore, it offers the advantage that no additional space is needed in order to arrange such a protective device within a plug connector opening.

The latch connection of the protective device within the plug connector device offers the advantage that this protective device cannot easily fall out of the plug connector opening, neither can it be easily pushed away due to incorrect handling.

Another advantage of the protective device according to the present invention is that, since the latching position, determined by the recesses in the inner wall of the plug connector opening in which latch elements of the protective device engage, can be freely selected, it is possible to attach the contact terminals, for example, for testing or programming a controller, even when the protective device is in the protective position. For this purpose, the protective device may be located 0.1 cm below the free end of the respective pin contact, for example, so that the free ends project from the openings in the protective device.

Another advantage of the present invention is that during the connection procedure, for example, while a cable harness plug is being inserted in the plug connector opening, the latch connection of the protective device is automatically released and the protective device is pressed along the pin contacts toward the bottom of the plug connector opening. For this purpose, a contact element arranged on the free end of a plug is provided, which may be designed in the shape of peg which may be pressed into a borehole of the latch element during insertion whereby the latch element is pulled out of the recesses of the plug connector opening thus releasing the latch connection. A groove-like recess provided on the free end of the peg-type formation of the contact element latches with the protective device when the plug is further pressed down, so that the plug and the protective device can only be moved back and forth together in the plug connector opening. When the plug is pulled out of the plug connector opening, the plug is pulled together with the protective device in the direction of the plug connector opening until the protective device is latched accordingly. By further pulling the plug, a snap connection between the plug and the protective device is also released, so that the protective device is now in the protective position again.

DETAILED DESCRIPTION

Figure 1:
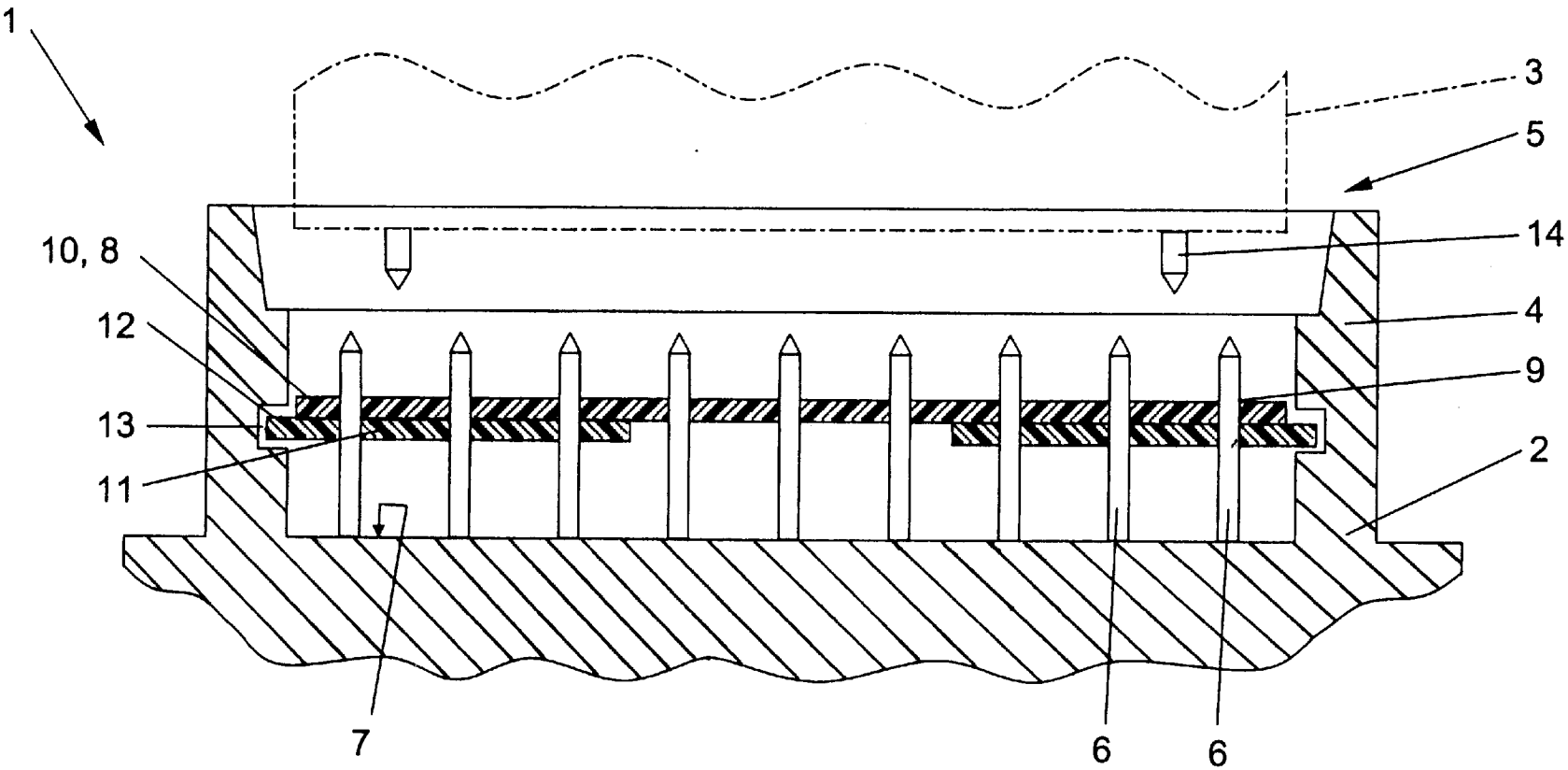
FIG. 1 shows a view of a plug-and-socket connector with a protective device according to the present invention in the protective position.
Figure 2:
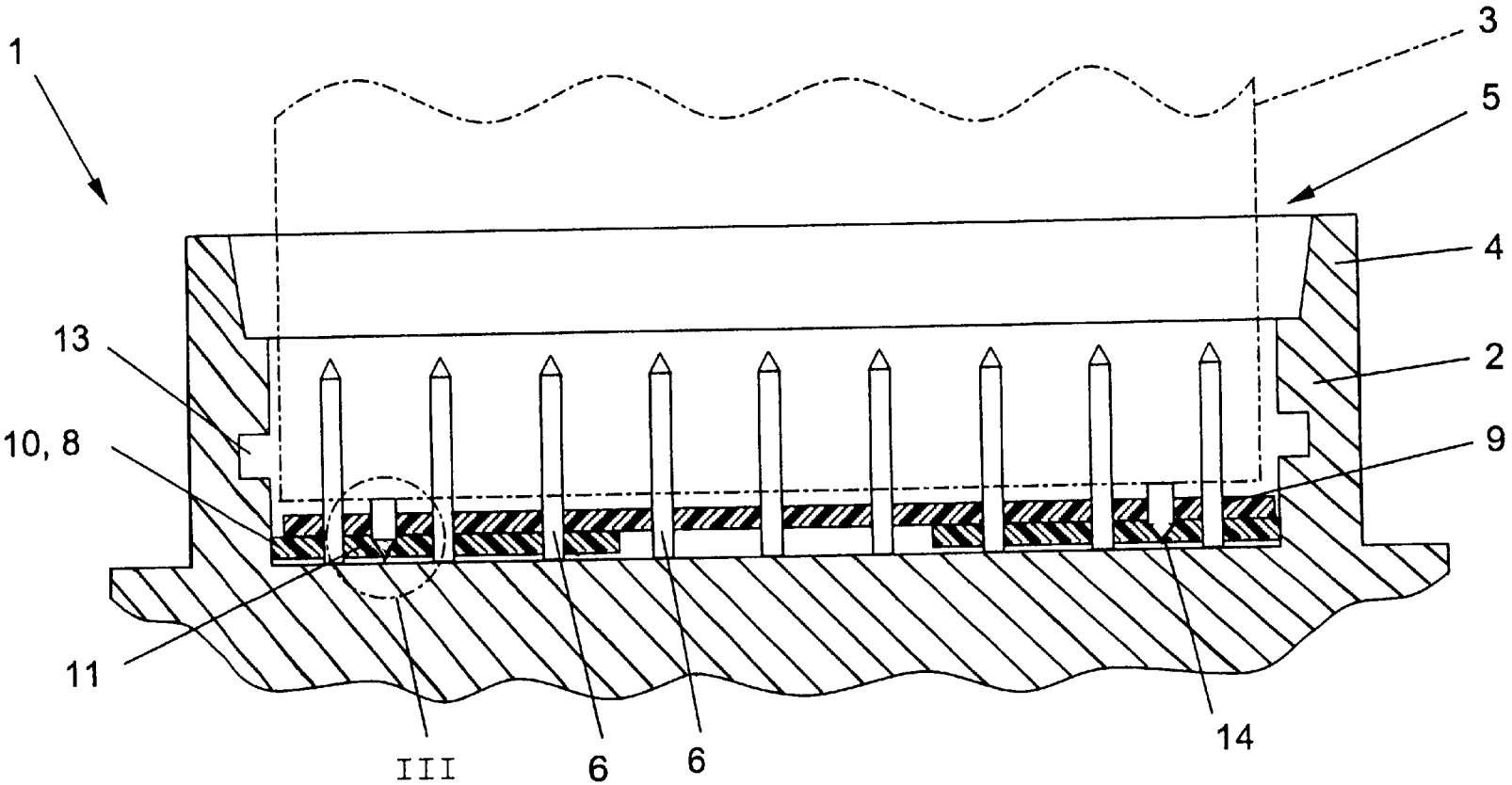
FIG. 2 shows another view of the plug-and-socket connector according to FIG. 1. Here, the plug-and socket connector is in an assembly position together with a plug.
Figure 3:
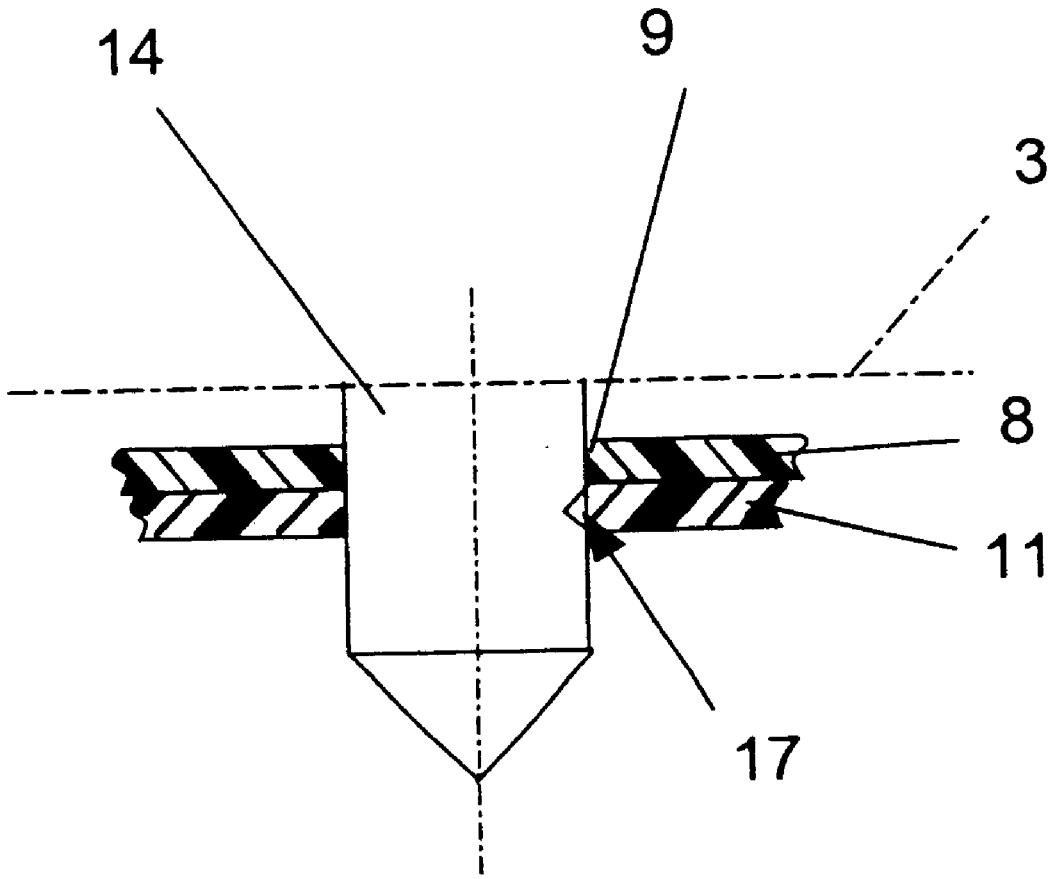
FIG. 3 shows an enlarged view of a contact element of the plug working together with the protective device.

FIGS. 1 through 3 show a plug-and-socket connection 1. This plug-and-socket connection 1 has a plug connector 2 and a plug 3, the latter being schematically illustrated in FIG. 2. The plug connector has a housing 4. A plug connector opening 5, in which pin contacts 6 are arranged, is provided in housing 4. These pin contacts 6 are arranged on housing bottom 7 and extend in the direction of plug connector opening 5. The depth of plug connector opening 5 is dimensioned so that pin contacts 6 do not extend beyond plug connector opening 5.

The depth of plug connector opening 5 in the embodiment of plug-and-socket connection 1 illustrated in FIGS. 1 through 4 is dimensioned so that pin contacts 6 extend to approximately one-half of the depth of plug connector opening 5. In particular, pin contacts 6 as shown in the figures having a very small cross-section are subject to damage, for example, bending.

For this reason, a protective device 8 is provided according to the present invention. The protective device 8 is designed in the shape of a plate or a strip and covers at least pin contacts 6 having a small cross-section. In the embodiment illustrated in FIG. 1, protective device 8 is in the protective position. In this position, pin contacts 6 having a small cross-section are covered due to the fact that openings 9 having a clear width at least corresponding to the cross-section of pin contacts 6 to be covered are provided in plate-shaped protective device 8. In the embodiment illustrated here, protective device 8 is arranged in the protective position so that at least the free ends of pin contacts 6 extend beyond protective device 8 so that, for example, a connection to pin contacts 6 can be established via contact terminals at least for testing purposes without removing or moving protective device 8 in any way.

Protective device 8 itself has plate-like formation 10 and latch elements 11 arranged on the side pointing away from plug connector opening 5 on the bottom side of plate-like formation 10. As is shown in the top view of latch elements 11 according to FIG. 4, latch elements 11 are slide elements capable of sliding in at least one direction, with free ends 12 of latch elements 11 engaging in housing-side recesses 13 to establish a latch connection of protective device 8 with plug connector 2. Latch elements 11 are mounted via a spring 14 so that the slide element endeavors to penetrate a housing-side recess 13 in every position of protective device 8.

Figure 4:
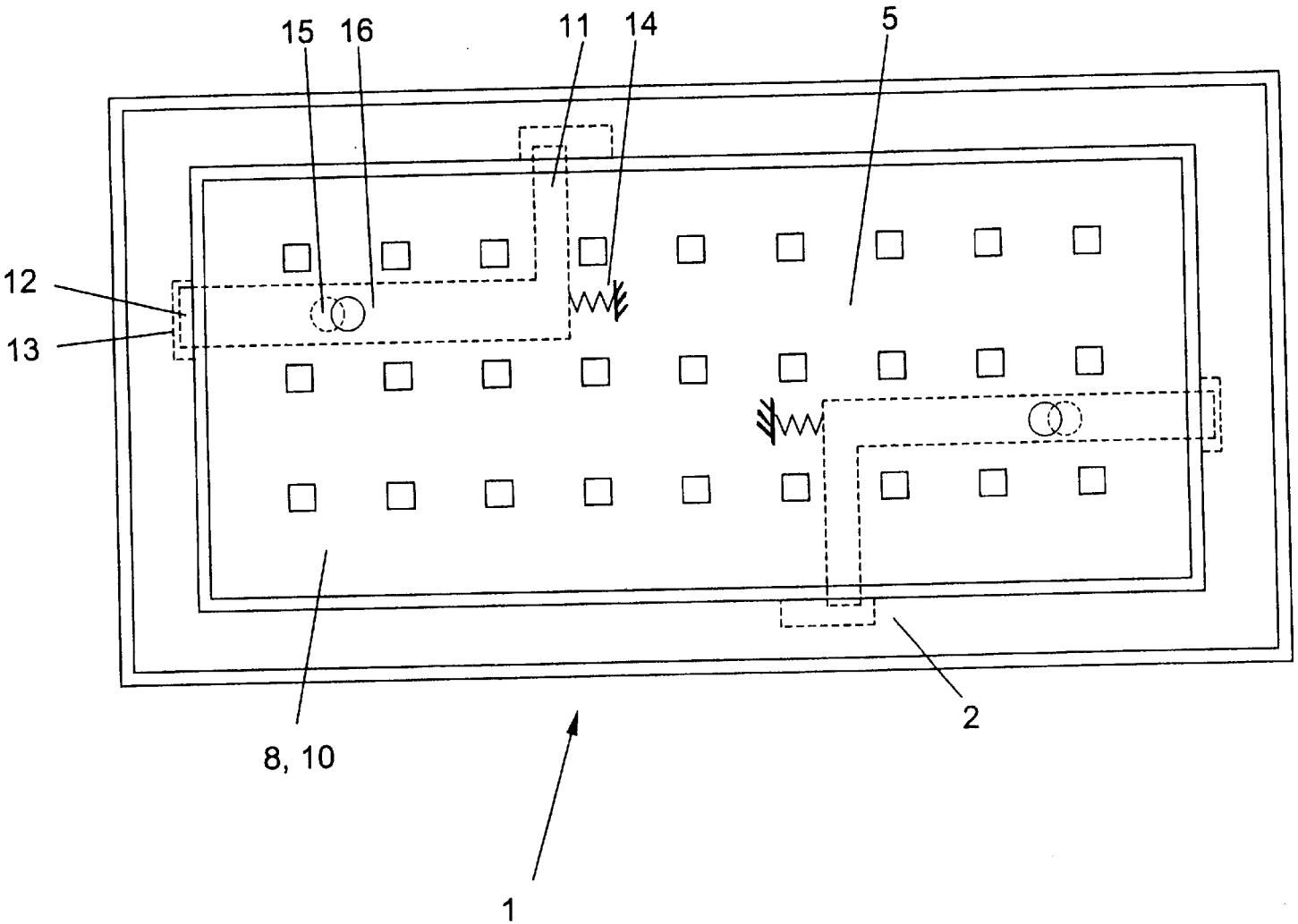
FIG. 4 shows a top view of the plug connector according to FIG. 1.
Figure 5:
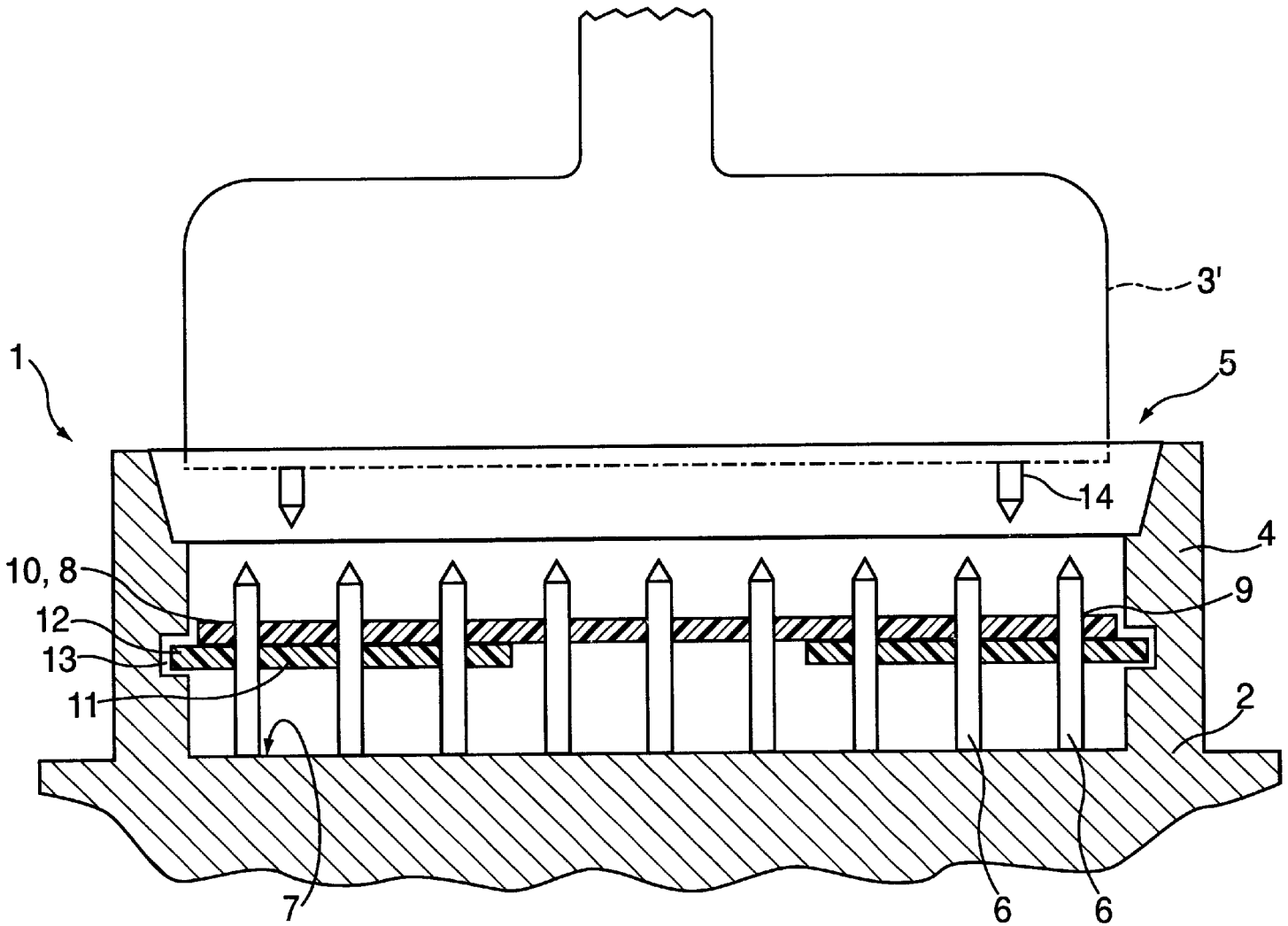
FIG. 5 shows a view of a plug-and-socket connector wherein the plug is a cable harness plug.

In order to establish a plug-and-socket connection 1, plug 3 is positioned on plug connector 2 as shown in FIG. 1 and is pressed toward housing bottom 7 until contact elements 14 pointing away from plug 3 penetrate boreholes 15 of protective device 8 as shown in FIG. 3. Due to the penetration of contact elements 14, which have a peg-type design, for example, the pegs slide on a predefined slide surface 16 during insertion, as schematically shown in FIG. 4, and latch elements 11 are moved so that they slide out of recesses 13 provided in housing 4 of plug connector 2, thus unlatching protective device 8. By further inserting plug 3 into plug connector opening 5, plug 3 is moved toward housing bottom 7 together with protective device 8. At this time, contact elements 14 further penetrate boreholes 15 in latch elements 11 until a groove-type formation 17 provided on the free ends of contact elements 14 latches with a part of protective device 8, thereby establishing the electrical contact between plug 3 and plug connector 2.

As plug 3 is pulled out of plug connector 2, protective device 8 is pulled out of plug connector opening 5 simultaneously with the movement of plug 3 initially due to groove-type formations 17 being latched to a part of protective device 8. This takes place until latch elements 11 have reached housing-side recesses 13 in plug connector opening 5 and there latch protective device 8 in the protective position due to their elastic mount. Plug 3 itself can be further pulled out, in which case the snap connection between contact elements 14 and protective device 8 is also released even by a slight pulling force.

Depending on the size of the field of pin contacts 6 to be covered, a plurality of latch elements 11 are provided in the periphery of protective device 8.

Protective device 8 can be installed in general whenever pin contacts 6 having a very small cross-section must be protected, particularly during transport or storage of plug-and-socket connections 1, in particular their plug connectors 2.

What is claimed is:

1. An electrical plug-and-socket connection, comprising:

a plug; and a plug connector including a housing having a plug connector opening and a plurality of pin contacts provided in the housing directed toward the plug connector opening to establish an electrical contact, the plug connector further including a protective device having at least one opening for passage of at least one of the pin contacts, the protective device including at least one latch element to latch the protective device in a protective position, wherein the at least one latch element engages in a recess in the housing of the plug connector for latching prior to joining the plug connector with the plug, the protective device being brought from the protective position into an assembly position by joining the plug connector with the plug, wherein the plug includes at least one contact element to actuate the protective device, the at least one contact element of the plug working together with the latch element to release a latch connection between the plug and the plug connector as the plug is attached to the plug connector.

2. The plug-and-socket connection according to claim 1, wherein the plug is a cable harness plug.

3. The plug-and-socket connection according to claim 1, wherein the at least one contact element has a peg-like design configured to be inserted into at least one borehole provided in the protective device.

4. The plug-and-socket connection according to claim 1, wherein the at least one contact element has a groove-type formation at a free end of the at least one contact element in which the protective device is latched.

5. The plug-and-socket connection according to claim 1, wherein the latch element is arranged directly on the protective device on a side facing away from the plug connector opening.

6. The plug-and-socket connection according to claim 1, wherein the latch element is mounted on the protective device using at least one spring.

7. The plug-and-socket connection according to claim 1, wherein the latch element is a slide element.

* * * * *